US006664773B1

(12) United States Patent
Cunnac et al.

(10) Patent No.: US 6,664,773 B1
(45) Date of Patent: Dec. 16, 2003

(54) VOLTAGE MODE VOLTAGE REGULATOR WITH CURRENT MODE START-UP

(75) Inventors: Loic Cunnac, Toulouse (FR); Paolo Migliavacca, Mauzac (FR); Philippe Goyhenetche, Fonsorbes (FR); Michael J. Gay, Vaud (CH)

(73) Assignee: Semiconductor Components Industries LLC, Phoenix, AZ (US)

( * ) Notice: Subject to any disclaimer, the term of this patent is extended or adjusted under 35 U.S.C. 154(b) by 0 days.

(21) Appl. No.: 10/153,986

(22) Filed: May 23, 2002

(51) Int. Cl.[7] ..... G05F 1/573
(52) U.S. Cl. ..... 323/277; 323/901; 323/281
(58) Field of Search ..... 323/901, 284, 323/277, 280, 281

(56) References Cited

U.S. PATENT DOCUMENTS

| | | | | |
|---|---|---|---|---|
| 5,545,970 A | | 8/1996 | Parkes, Jr. et al. | |
| 5,629,610 A | * | 5/1997 | Pedrazzini et al. | 323/283 |
| 5,666,044 A | | 9/1997 | Tuozzolo | |
| 6,246,555 B1 | * | 6/2001 | Tham | 361/18 |
| 6,525,517 B1 | * | 2/2003 | Hojo et al. | 323/316 |

* cited by examiner

*Primary Examiner*—Shawn Riley
(74) *Attorney, Agent, or Firm*—Robert F. Hightower

(57) ABSTRACT

A voltage regulator (15) utilizes a first current source (31) and a second current source (32) to form a reference current to limit current flow through an output transistor (13) during a start-up period. After the start-up period expires, the first current source (31) is disabled and the voltage regulator (15) controls the output voltage produced by the output transistor (13) instead of controlling the current flow through the output transistor (13).

16 Claims, 2 Drawing Sheets

VOLTAGE MODE VOLTAGE REGULATOR WITH CURRENT MODE START-UP

BACKGROUND OF THE INVENTION

The present invention relates, in general, to electronics, and more particularly, to methods of forming semiconductor regulators and structures.

In the past, the electronics industry utilized various techniques for implementing voltage regulator systems. One particular type often referred to as continuous time mode or linear regulators have wide application. Typically, a linear voltage regulator included a linear amplifier that sensed the output voltage and compared it to a desired voltage reference. If the output voltage was less than the reference voltage, the linear amplifier enabled a output transistor to increase the voltage applied to the output. One particular problem occurred when restarting from a power down or standby mode. A capacitor typically was connected in parallel with the load. During the power down or stand-by mode, the capacitor discharged. Upon applying power, the linear amplifier sensed the low voltage and drove the output transistor to quickly charge the load capacitor. The resulting load current during this start-up period generally was much greater than the desired operating load current value. For many applications, such as battery powered operations, the large load current resulted in damaging the battery and shortening the useful battery lifetime.

Accordingly, it is desirable to have a voltage regulator that limits load current during the start-up mode, that does not damage the battery during the start-up mode, and that does not reduce the battery's useful lifetime.

For simplicity and clarity of illustration, elements in the figures are not necessarily to scale. Additionally, descriptions and details of well known steps and elements are omitted for simplicity of the description.

DETAILED DESCRIPTION OF THE DRAWINGS

Figure 1:
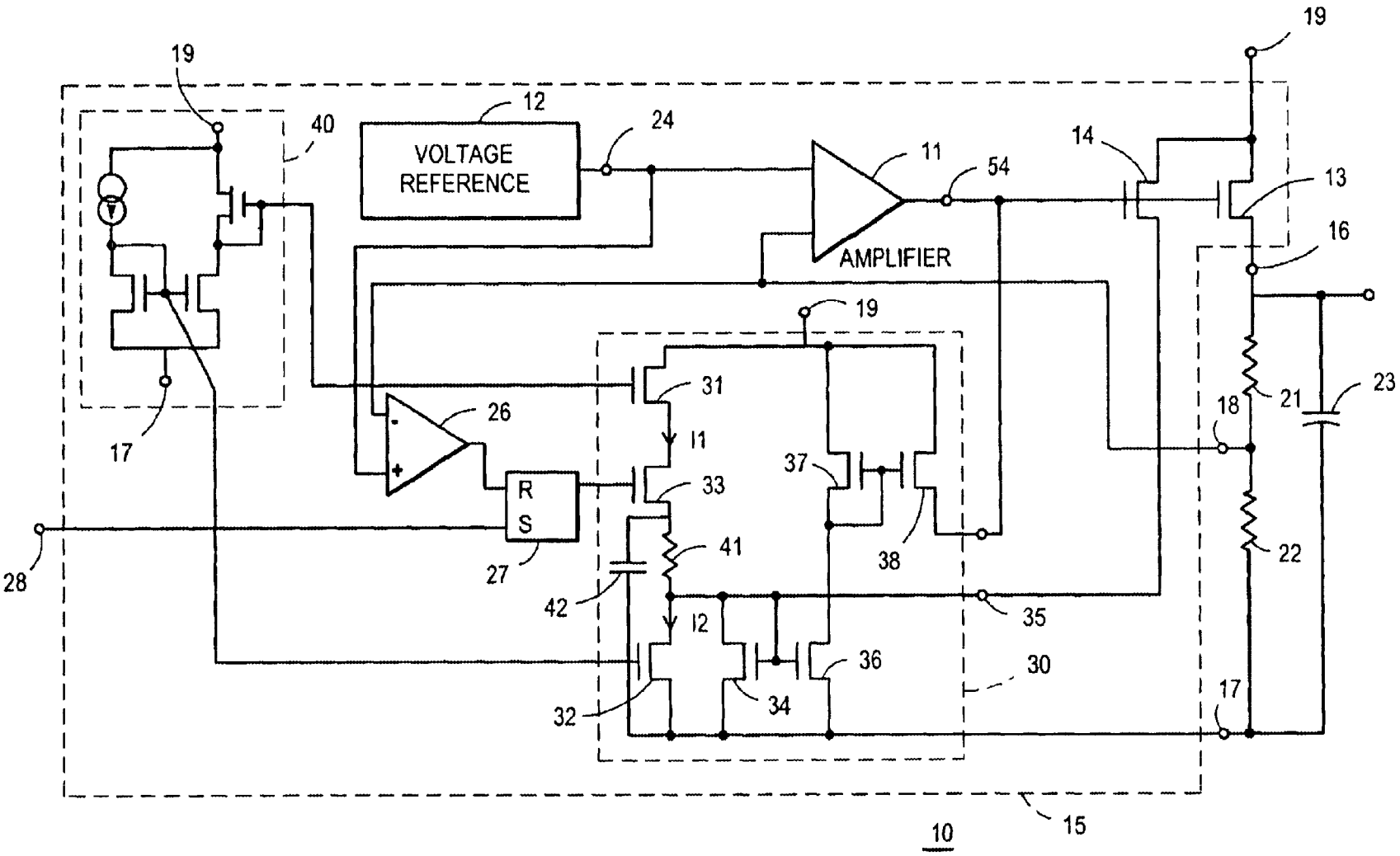
FIG. 1 schematically illustrates a portion of an embodiment of a system that utilizes a voltage regulator in accordance with the present invention.

FIG. 1 schematically illustrates a portion of an embodiment of a system 10 that utilizes a voltage regulator 15, generally illustrated by a dashed box. During a start-up mode or start-up period, voltage regulator 15 operates in a current limit mode by limiting the load current that is provided by an output transistor 13. After the start-up period, regulator 15 operates in a voltage control mode by controlling the output voltage instead of controlling the load current. Regulator 15 includes an amplifier 11 that drives output transistor 13, a voltage reference 12 that supplies a first reference voltage, a current limiter 30 illustrated by a dashed box, and a control section that includes a set-reset flip-flop 27 and a comparator 26.

Regulator 15 has a voltage source input 19 that is connected to a power source such as a battery. Output transistor 13 receives the voltage applied to input 19 and provides an output voltage on a voltage output 16. Output transistor 13 has a first current carrying electrode connected to input 19 and a second current carrying electrode connected to output

16. A sense transistor 14 is coupled to responsively respond with output transistor 13 to provide a sense current representing the value of the load current supplied by transistor 13. Sense transistor 14 has a first current carrying electrode connected to input 19 and a second current carrying electrode connected to a sense input 35 of current limiter 30. The control electrodes of both transistors 13 and 14 are connected to the output of amplifier 11. Sense transistor 14 is typically ratioed to be a certain percent smaller than transistor 13 and produces a sense current that is smaller than the load current by that ratio. In the preferred embodiment, the ratio is about four thousand to one (4000:1). In the preferred embodiment, transistors 13 and 14 are PMOS transistors, although they may also be PNP transistors or other types of pass devices. Regulator 15 receives a feedback voltage on a feedback input 18 of regulator 15. The feedback voltage follows variations in the value of the output voltage on output 16. Typically the feedback voltage is derived from the output voltage by an external resistor divider in series with output transistor 13 such as illustrated by resistors 21 and 22. Resistor 21 has a first terminal connected to output 16 and a second terminal connected to input 18. Resistor 22 has a first terminal connected to input 18 and a second terminal connected to a power return 17. In the preferred embodiment, resistors 21 and 22 have a divider ratio of about 2.5:1. System 10 typically has a capacitor 23 connected in parallel with the load in order to integrate or smooth variations in the value of the output voltage.

Amplifier 11 receives the feedback voltage via a first amplifier input that is connected to feedback input 18. A second amplifier input is connected to receive the first reference voltage from a first reference output 24 of voltage reference 12. During normal operation, amplifier 11 decreases or increases the voltage on the control electrode of transistors 13 and 14 when the value of the feedback voltage is less than or greater than, respectively, the value of the first reference voltage on first reference output 24. Amplifier 11 drives transistors 13 and 14 responsively to the feedback voltage in order to control the output voltage at a desired value. Amplifier 11 typically includes a differential amplifier that compares the feedback voltage to the first reference voltage, and a buffer having a single ended output 54 that drives output transistor 13 in proportion to the difference between the feedback voltage and the first reference voltage.

Current limiter 30 functions to limit the load current through transistor 13 during the start-up period and also to limit the maximum load current during normal operation. Limiter 30 has a start-up current source formed by start-up current transistor 31 that provides a first reference current or start-up reference current (I1) during the start-up period, and an operating current source-formed by an operating current transistor 32 that provides a second reference current or operating reference current (I2) used during both normal operation and the start-up period. Transistor 31 is formed as a transistor that has a control electrode connected to a first bias voltage that is formed by a bias circuit 40. However, those skilled in the art understand that the first bias voltage may be formed elsewhere. Transistor 31 also has a first current carrying electrode connected to input 19. The operating current source is formed from transistor 32 that also has a control electrode connected to bias circuit 40. Those skilled in the art understand that the first and second bias voltages may be formed at any appropriate location.

Regulator 15 receives a start signal indicating a start-up from a power down or stand-by mode on a start-up input 28. Start-up input 28 is connected to an input of set-30 reset flip-flop or R/S flop 27. The start-up signal sets the output of R/S flop 27, and the output enables a switch transistor 33 which applies power to transistor 31 allowing the start-up reference current (I1) to flow through transistor 31. Transistor 32 is always enabled to supply the operating reference current I2. When the value of the sense current from input 35 plus the value of the start-up reference current (I1) from transistor 31 equal the value of the operating reference current (I2) from transistor 32, a reference transistor 34 is enabled. Therefore, the start-up reference current from transistor 31 flows through transistor 32 supplying a portion of the operating current to transistor 32 and reducing the sense current required to enable transistor 34. Transistor 34 and a transistor 36 form a current mirror that mirrors the current flowing through transistor 36 to the current mirror of transistors 37 and 38 and enabling transistor 38. The output of transistor 38 is connected to the output of amplifier 11 and overrides the output provided by amplifier 11. Transistor 38 forces the control electrode of transistors 13 and 14 high to limit the value the of the load current provided by output transistor 13 and the sense current provided by transistor 14. Thus, current limiter 30 controls the load current provided by transistor 13 to protect transistor 13 and the voltage source connected to input 19. Because of the reduced current, capacitor 23 charges at a slow rate and the voltage on output 16 also increases at a slow rate.

Comparator 26 facilitates terminating the start-up period. Comparator 26 has a positive input connected to reference output 24 of voltage reference 12, a negative input connected to feedback input 18, and an output connected to the reset input of R/S flop 27. The positive input of comparator 26 has an offset that functions to provide a second reference voltage that is less that the first reference voltage on output 24 to ensure that comparator 26 switches prior to amplifier 11 providing the voltage regulation of the output voltage. Preferably, the value of the second reference voltage is not greater than about twenty to thirty milli-volts (20–30 millivolts) less than the value of the first reference voltage to ensure the desired operation of amplifier 11. At the point when the feedback voltage on feedback input 18 increases to a value equal to the second reference voltage value on second reference output 25, the output of comparator 26 goes high and resets or clears R/S flop 27. This disables or opens switch transistor 33 and removes power from transistor 31. The start-up reference current (I1) from transistor 31 stops flowing. However, the operating reference current (I2) from transistor 32 continues to flow. Without the current from transistor 31, the sense current from transistor 14 is no longer sufficient to enable transistor 34. Thus, transistors 36, 37, and 38 are all disabled through the current mirror configuration, and transistor 38 releases the output of amplifier 11 thereby terminating the start-up period. Consequently, amplifier 11 is now able to control transistor 13 via the voltage from feedback input 18. Thus, limiter 30 limits the output current or load current through transistor 13 to a first value during the start-up period, and amplifier 11 controls the output voltage on output 16 during a normal operating period. However, if the sense current from transistor 14 becomes too high and equals the current from transistor 32 (I2), limiter 30 once again limits the output current but at a higher current determined by the operating reference current (I2) from transistor 32. In the preferred embodiment, the start-up reference current (I1) is approximately one-half the value of the operating reference current (I2) of transistor 32. Consequently, enabling both the first and second current sources during the start-up period forms a first reference current and disabling the second current source after the start-up period forms a second reference current that is larger than the first reference current. It should be noted that start-up transistor 31 is not enabled until another start signal is received on input 28. Thus, even if the output voltage decreases an amount such that the feedback voltage decreases to a value less than the value of the second reference voltage, the start-up reference current remains disabled.

To facilitate this operational mode, a control electrode of transistor 33 is connected to the output of R/S flop 27. A first current carrying electrode of transistor 33 is connected to a second current carrying electrode of transistor 31. Limiter 30 receives the sense current from sense transistor 14 on current sense input 35 that is connected to a first current carrying electrode of transistor 34, a control electrode of transistor 34, a control electrode of transistor 36, and to a first current carrying electrode of transistor 32. A second current carrying electrode of transistor 34, a first current carrying electrode of transistor 36, and a second current carrying electrode of transistor 32 are connected to power return 17. A second current carrying electrode of transistor 36 is connected to a first current carrying electrode of transistor 37, and to a control electrode of both transistors 37 and 38. A second current carrying electrode of transistors 37, and 38 is connected to input 19. In the preferred embodiment, transistors 31, 33, 37, and 38 are PMOS transistors, and transistors 32, 34, and 36 are NMOS. Also in the preferred embodiment, a compensation network of a resistor 41 and a capacitor 42 functions to avoid oscillations on output 16. Resistor 41 has a first terminal connected to the second current carrying electrode of transistor 33, and a second terminal connected to the fist current carrying electrode of transistor 32. Capacitor 42 has a first terminal connected to the first terminal of resistor 41 and a second terminal connected to return 17.

Figure 2:
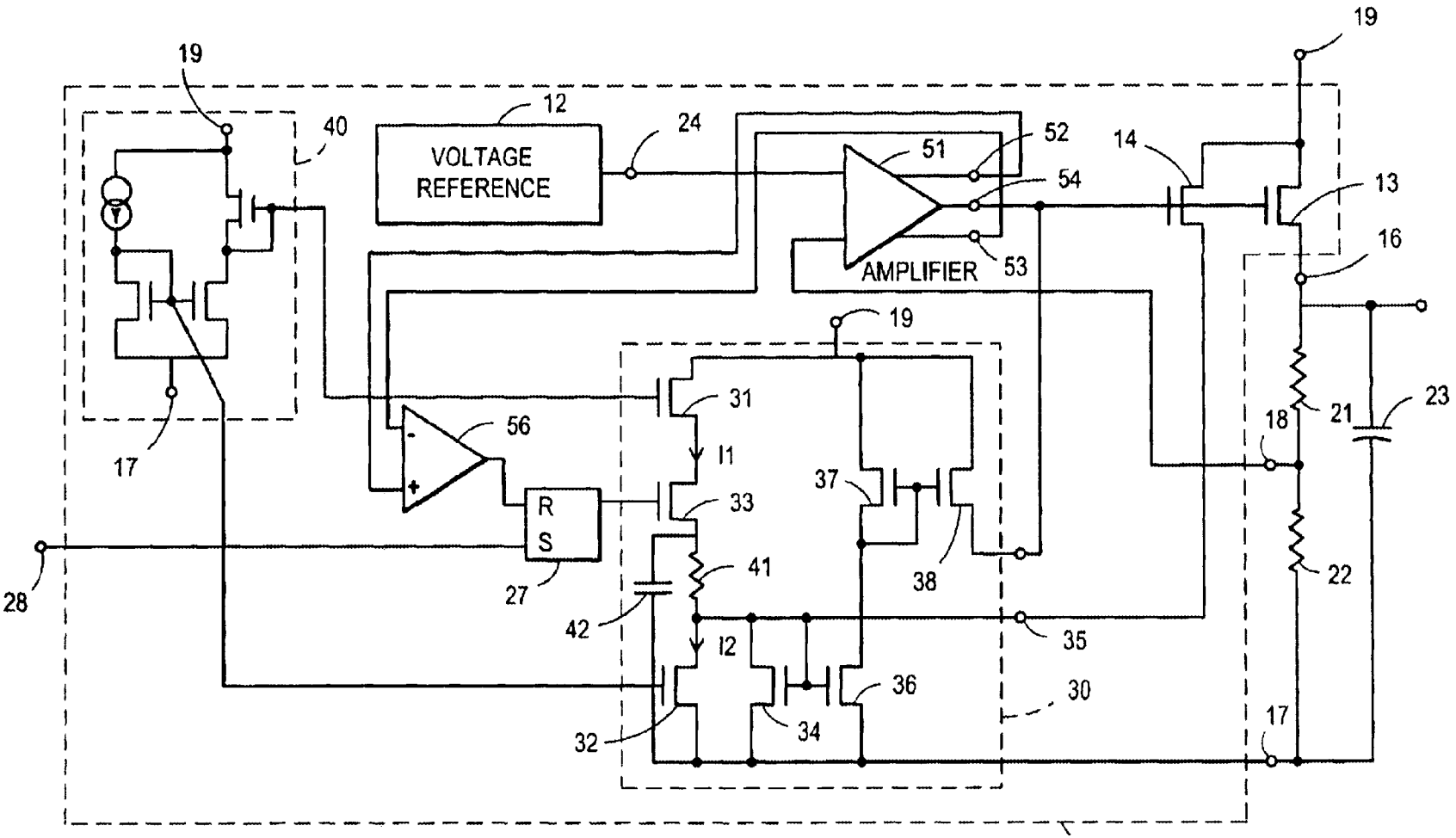
FIG. 2 schematically illustrates a portion of an embodiment of a system that is an alternate embodiment of the system in FIG. 1 in accordance with the present invention.

FIG. 2 schematically illustrates a portion of an embodiment of a system 50 that is an alternate embodiment of system 10. System 50 includes a voltage regulator 55, illustrated generally by a dashed box, that is an alternate embodiment of regulator 15. During the start-up mode or start-up period, voltage regulator 55 is formed to operate in the current limit mode by limiting the load current that is provided by output transistor 13. After the start-up period, regulator 55 is formed to operate in the voltage control mode by controlling the output voltage instead of controlling the load current. Regulator 55 is formed to also include, among other things, a comparator 56 and an amplifier 51. Amplifier 51 is formed to drive output transistor 13 and provide inputs to comparator 56.

Amplifier 51 receives the feedback voltage via a first amplifier input that is connected to feedback input 18. A second amplifier input is connected to receive the first reference voltage from first reference output 24. Amplifier 51 includes a differential amplifier that receives the feedback voltage and the first reference voltage and provides a differential output representing the difference between the feedback voltage and the first reference voltage amplified by a gain of amplifier 51. The amplified differential output is provided on amplifier outputs 52 and 53. Amplifier 51 also includes a buffer that receives the feedback voltage and the first reference voltage and provides a drive voltage on single ended output 54. The drive voltage represents the difference between the feedback voltage and the first reference voltage and is used to drive output transistor 13 in proportion to the difference between the feedback voltage and the first reference voltage. During normal operation, amplifier 51 decreases or increases the voltage on the control electrode of transistors 13 and 14 when the value of the feedback voltage is less than or greater than, respectively, the value of the first reference voltage. Amplifier 51 drives transistors 13 and 14 responsively to the feedback voltage in order to control the output voltage at a desired value.

Comparator 56 facilitates terminating the start-up period. Comparator 56 has a positive input connected to differential output 52, a negative input connected to differential output 53, and an output connected to the reset input of R/S flop 27. Comparator 56 is formed to have an internal offset voltage that causes comparator 56 to switch states when the differential input voltage to comparator 56 is greater than the offset voltage of comparator 56. The value of the offset voltage of comparator 56 is selected to ensure that the load on output 16 charges to a first value prior to regulator 55 switching to the voltage regulation mode. Typically the first value is about one to two per cent (1–2%) less than the desired operating value of the output voltage on output 16. The difference between the desired output voltage value and the first value can be referred to as a switch delta. To determine the offset voltage for comparator 56, the value of the switch delta is multiplied by the ratio of the resistor divider of resistors 21 and 22 and by the gain of amplifier 11. For example, if the switch delta is chosen to be twenty milli-volts (20 mV) and the divider ratio is 2.5: 1, and the gain of amplifier 51 is sixteen (16), then the comparator 56 offset voltage would be one hundred twenty eight milli-volts ((20/2.5)×16=128 mV). In the preferred embodiment, the switch delta is between approximately fifteen and thirty milli-volts (15–30 mV) and the gain of amplifier 51 is between about fifteen and twenty (15–20). At the point when the output voltage on output 16 increases to a value equal to the first voltage, the output of comparator 56 goes high and resets or clears R/S flop 27 thereby disabling or opening switch transistor 33, and when the output voltage increase a second amount equal to the switch delta amplifier 51 begins to drive transistor 13 in the voltage regulation mode. Thus, the second value is larger than the first value and regulator 55 is formed to control the output voltage value after the output voltage value reaches the second value. Using the current regulation mode for charging the capacitive load on output 16 to the first value prior to switching to the voltage regulation mode ensures that the load is charged at a slow rate until the voltage is very close to the desired operating voltage and ensures that the load is only charged a small amount in the voltage regulation mode thereby the limiting the charging current used for charging the load and increasing the useful lifetime of the voltage source connected to voltage source input 19.

While the invention is described with specific preferred embodiments, it is evident that many alternatives and variations will be apparent to those skilled in the semiconductor arts. More specifically the invention has been described for particular PMOS and NMOS transistor structures, although the method is directly applicable to bipolar transistors, as well as to MOS, BiCMOS, metal semiconductor FETs (MESFETs), HFETs, and other transistor structures.

What is claimed is:

1. A method of forming a voltage regulator comprising:

forming the voltage regulator to limit a current flow through an output transistor to a first value during a start-up period and to control an output voltage value formed by the output transistor instead of the current flow after the start-up period including forming the voltage regulator to enable a first current source and a second current source to generate a first reference current during the start-up period and to disable the second current source after the start-up period to form a second reference current that is greater than the first reference current.

2. The method of claim 1 further including forming the voltage regulator having a comparator having an offset voltage that is a function of a gain of a differential amplifier of the voltage regulator wherein a value of the offset voltage establishes a first output voltage value for disabling the second current source.

3. The method of claim 1 wherein forming the voltage regulator to enable the first current source and the second current source to generate the first reference current during the start-up period includes coupling the first current source in parallel with a reference transistor and coupling the first current source to receive current from the second current source and to receive a sense current from a sense transistor responsively coupled to form the sense current to represent the current flow through the output transistor.

4. The method of claim 3 wherein coupling the first current source in parallel with the reference transistor includes forming the reference transistor to conduct current after the sense current plus the first reference current approximately equals the second reference current.

5. The method of claim 1 wherein forming the voltage regulator to limit the current flow through the output transistor to the first value during the start-up period includes forming the voltage regulator to enable the second current source in response to receiving a start-up signal, and to disable the second current source after the output voltage value reaches a first value.

6. The method of claim 5 wherein forming the voltage regulator to enable the second current source in response to receiving the start-up signal and to disable the second current source after the output voltage value reaches the first value includes forming the voltage regulator to control the output voltage value after the output voltage value reaches a second value that is larger than the first value.

7. A method of forming a voltage regulator comprising:

forming a current limit circuit to enable both a first current source and a second current source to provide a first reference current to set a drive voltage of an output transistor during a start-up period; and forming the current limit circuit to disable the first reference current after the start-up period.

8. The method of claim 7 wherein forming the current limit circuit to disable the first reference current after the start-up period includes forming the current limit circuit to disable the first reference current after an output voltage reaches a first value.

9. The method of claim 8 further including forming the voltage regulator to regulate the output voltage provided by the output transistor after the output voltage reaches a second value that is greater than the first value.

10. The method of claim 9 further including forming the current limit circuit to use a second reference current after the start-up period wherein the second reference current is larger than the first reference current.

11. The method of claim 10 further including forming the current limit circuit to use the second reference current after the output voltage reaches the first value and before the output voltage reaches the second value.

12. A voltage regulator comprising:

an output transistor having a first current carrying electrode coupled to a voltage source, a second current carrying electrode coupled to an output of the voltage regulator, and a control electrode;

a sense transistor having a first current carrying electrode coupled to the voltage source, a control electrode coupled to the control electrode of the output transistor, and a second current carrying electrode;

a reference transistor having a first current carrying electrode coupled to the second current carrying electrode of the sense transistor, a control electrode coupled to the first current carrying electrode, and a second current carrying electrode coupled to a power return;

a first current source transistor having a first electrode coupled to the first current carrying electrode of the reference transistor, and a second electrode coupled to the second current carrying electrode of the reference transistor; and a second current source transistor having a first current carrying electrode coupled to the voltage source, and a second current carrying electrode coupled to the first current carrying electrode of the reference transistor through a switch transistor.

13. The voltage regulator of claim 12 wherein the second current source transistor having the first current carrying electrode coupled to the voltage source, and the second current carrying electrode coupled to the first current carrying electrode of the reference transistor through the switch transistor includes the switch transistor having a first current carrying electrode coupled to the first current carrying electrode of the reference transistor, a second current carrying electrode coupled to the second current carrying electrode of the second current source transistor, and a control electrode coupled to responsively receive a start-up signal.

14. The voltage regulator of claim 12 further including a first transistor coupled in a first current mirror configuration with the reference transistor.

15. The voltage regulator of claim 14 further including a second current mirror coupled in a second current mirror configuration with the reference transistor.

16. The voltage regulator of claim 15 wherein the second current mirror includes a second transistor having a current carrying electrode coupled to the control electrode of the output transistor.

* * * * *